United States Patent [19]

Yamaguchi et al.

[11] Patent Number: 4,809,978

[45] Date of Patent: Mar. 7, 1989

[54] GOLF CLUB HEAD

[75] Inventors: Tetsuo Yamaguchi; Koichiro Kurahashi, both of Kobe, Japan

[73] Assignee: Sumitoto Rubber Industries, Ltd., Kobe, Japan

[21] Appl. No.: 7,594

[22] Filed: Jan. 28, 1987

Related U.S. Application Data

[63] Continuation-in-part of Ser. No. 633,227, Jul. 23, 1984, abandoned.

[30] Foreign Application Priority Data

Jul. 29, 1983 [JP] Japan ..... 58-140417

[51] Int. Cl.[4] ..... A63B 53/04

[52] U.S. Cl. ..... 273/78; 273/173; 273/DIG. 22

[58] Field of Search ..... 273/DIG. 22, 167 J, 273/173, 174, 78, 235, 227, 175, 167 F, 167 R, 167 B, 167 H, 167 K, 168

[56] References Cited

U.S. PATENT DOCUMENTS

| | | | |
|---|---|---|---|
| 622,834 | 4/1899 | Work et al. | 273/227 |
| 723,258 | 3/1903 | Felton | 273/78 |
| 1,359,220 | 11/1920 | Beamer | 273/78 |
| 2,447,967 | 8/1948 | Stone | 273/78 |
| 3,218,072 | 11/1965 | Burr | 273/167 J |
| 3,266,805 | 8/1966 | Bulla | 273/78 |
| 3,359,231 | 12/1967 | Kent | 273/235 |
| 3,937,474 | 2/1976 | Jepson et al. | 273/173 |
| 4,181,306 | 1/1980 | Jepson | 273/173 |
| 4,445,688 | 5/1984 | Frillici | 273/DIG. 22 |
| 4,687,205 | 8/1987 | Tominaga et al. | 273/169 |

FOREIGN PATENT DOCUMENTS

| | | | |
|---|---|---|---|
| 2124910 | 2/1984 | United Kingdom | 273/78 |

OTHER PUBLICATIONS

"Modern Plastics Encyclopedia", 1976–1977, pp. 32 and 33, relied on.

*Primary Examiner*—George J. Marlo

*Attorney, Agent, or Firm*—Birch, Stewart, Kolasch & Birch

[57] ABSTRACT

A golf club head of a wood-type or an iron-type golf club having a face plate forming a part of the entire impact front face of the club head, and the face plate is formed of an ionomer resin having a compression Young's modulus in the range of 20 to 50 Kg/mm$^2$.

11 Claims, 3 Drawing Sheets

GOLF CLUB HEAD

This is a continuation-in-part of U.S. patent application Ser. No. 633,227 filed July 23, 1984, and now abandoned.

BACKGROUND AND SUMMARY OF THE INVENTION

The present invention relates to a golf club head, and more particularly to an improved face plate forming a part of or forming the entire impact front face of a club head on which a gold ball is hit.

It is generally known that a golf club head is comprised of a single type of material or a combination of many different types of materials such as wood, metal, carbon and synthetic resins.

It is also generally recognized that the greater the degree of hardness of the face plate, the greater the restitution coefficient will be between the golf ball and the golf club upon impact with the face plate, and that the greater the restitution coefficient will be between the golf ball and the golf club, and also the greater will be the distance travelled by the golf ball. This is taught for example, by U.S. Pat. No. 4,181,306 to Jepson (Column 1, lines 36 to 39). In fact, many wood-type golf club heads, each having a face plate made of a hard material such as stainless steel, ABS resin or the like, have been proposed and are now available in the commercial markets. On the other hand, many iron-type gold club heads currently available are entirely made of metal such as stainless steel which is naturally hard, and for that matter, provides a hard metallic impact front face. Thus, it has been the general and conventional concept that it is unnecessary to provide the iron-type golf club head with a face plate.

In general, every golfer has a strong desire to increase the distance travelled by a golf ball which the golfer has hit (hereinafter referred to as "flying distance"). Therefore, a golfer is always looking for an improved golf club which enables such a desired increase in the flying distance traveled by a golf ball. However, it appears to be very difficult to meet the golfer's demand, as long as the conventional concept that, the greater the degree of hardness of the face plate, the greater the flying distance which can be obtained, is adhered to.

Among the various known materials for conventional face plates, both balata and gutta-percha have a compression Young's modulus in the range 0.6 $Kg/mm^2$ to 2 $Kg/mm^2$, which value is too small to enable a golf ball to travel a long flying distance. Thus the material for a face plate taught by U.S. Pat. No. 723,258 for Felton and U.S. Pat. No. 3,359,231 for Kent (balata and gutta percha resin) are some of the worst materials that can be use for a face plate, since these materials are too soft ABS resin is considered to be small in compression Young's modulus E, the value of which is as small as about 280 $kg/mm^2$. It has been considered that materials having compression Young's modulus E values which are substantially smaller than 280 $Kg/mm^2$ cannot be practically useful in the manufacture of face plates, although it has been known to use an ionomer resin having a Young's modulus E of about 20 $kg/mm^2$ to 50 $Kg/mm^2$ for a golf ball (Modern Plastics Encyclopedia, 1976–1977, Pages 32 to 33). Nevertheless, according to the present invention, a specific synthetic resin, having a compression Young's modulus E value which is extremely small, is utilized as the material for a face plate.

Thus, it can be said that the present invention is based on a far departure from the conventional sense and knowledge in the field of golf clubs.

It is, therefore, an object of the present invention to provide an improved golf club head which permits an increase in the flying distance of a golf ball hit thereby.

Another object of the present invention is to provide an improved golf club head having a face plate which is formed of an ionomer resin having a compression Young's modulus value which is in the range of 20 to 50 $Kg/mm^2$.

Other objects, features and advantages of the present invention will become apparent from the detailed description given hereinafter in connection with the accompanying drawings.

DESCRIPTION OF THE PREFERRED EMBODIMENT

Figure 1:
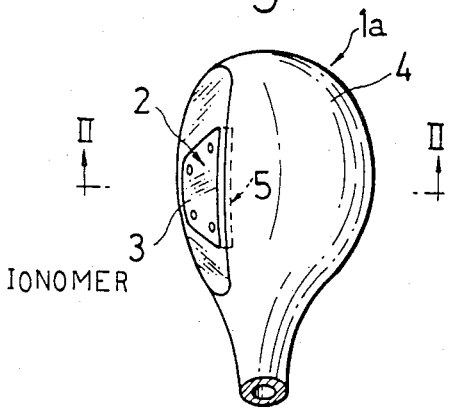
FIG. 1 is a top plan view illustrating a wood-type golf club head embodiment of the present invention.
Figure 2:
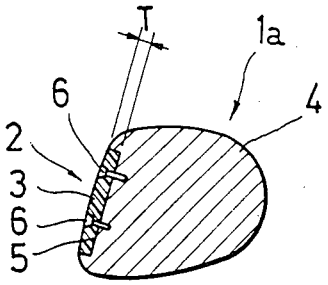
FIG. 2 is a cross section taken along lines II—II of FIG. 1.
Figure 3:
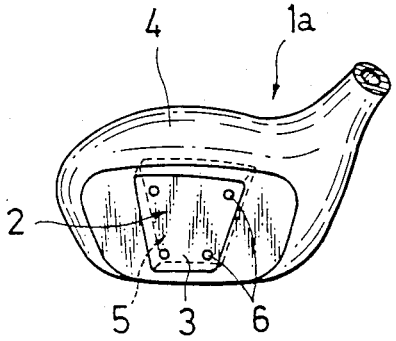
FIG. 3 is a front elevational view of the golf club head shown in FIG. 1.

Referring now to the accompnying drawings, in particular to FIGS. 1 to 3, there is illustrated wood-type golf club head 1*a* having face plate 3 of 3 to 35 mm in thickness T embedded conventionally in an appropriate recess 5 formed substantially in the center of impact front face 2 of club head body 4.

Face plate 3 is formed of an ionomer resin, a type of thermoplastic resin, being 3 to 35 mm in thickness T as described. The ionomer resin, per se is known and is manufactured by E. I. Du PONT DE NEMOURS & CO. of U.S.A. It is now available in commercial markets under the trademark "SURLYN".

Face plate 3 should be formed substantially identical in configuration to recess 5 which is also 3 to 35 mm in thickness, so that face plate 3 can fit tightly into recess 5 and form a part of plain impact front face 2, conventionally. Both face plate 3 and recess 5 are illustrated as being substantially trapezoidal in frontal shape, but they may be of any other suitable shape.

Club head body 4 of the wood-type golf club may typically be made of hard wood. However, it is possible to make club head body 4 of any other suitable material such as synthetic resin, carbon or light alloy, instead of wood.

Figure 4:
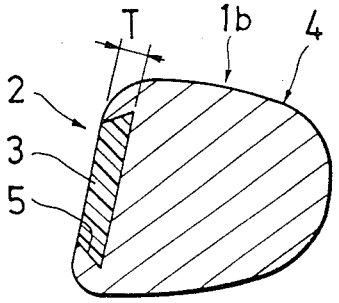
FIG. 4 and 5 are similar views to FIG. 2, with each showing a modified face plate arrangement.

Face plate 3 may be permanently fixed to recess 5 by means of known adhesives and/or known mechanical fixing members such as screws 6. If desired, the so-called dovetail structure as illustrated in FIG. 4 may be employed, together with adhesives and/or mechanical fixing members 6, for a firm engagement of face plate 3 with recess 5.

Figure 5:
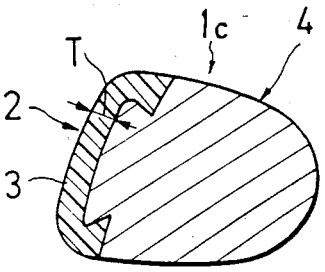

As illustrated in FIG. 5, face plate 3 may be applied so as to cover the entire front face of the club head body. In this case, whole impact front face 2 of club head 1*c* is formed by the external surface of face plate 3.

Figure 7:
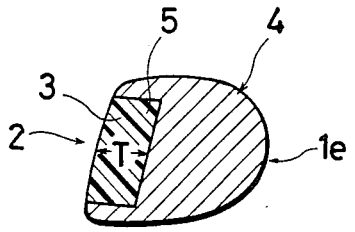
FIG. 7 is a similar view to FIG. 2, with showing a modified face plate arrangement.

As illustrated in FIG. 7, face plate 3 of wood-type golf head 1*e* is sufficiently thick, for example, 15 to 35 mm, and is permanently fixed in the recess by means of known adhesives.

Figure 8:
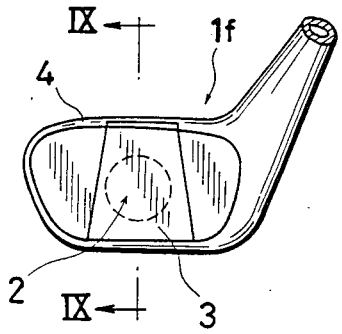
FIG. 8 is a front elevational view illustrating another embodiment of the golf club head.
Figure 9:
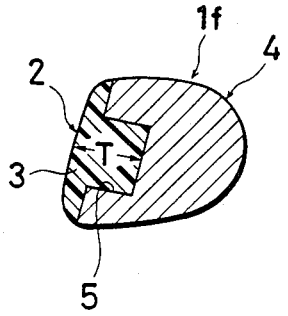
FIG. 9 is a cross section taken along lines IX—IX of FIG. 8.

FIGS. 8 and 9 illustrate a further embodiment of the present invention, wherein the recess has a step, and the depth of the center of the front face is larger than the other part. The ionomer resin made face plate of wood-type golf club head 1*f* has the maximum value in thickness T on the sweet spot. The maximum value in thickness T is 8–35 mm.

Figure 10:
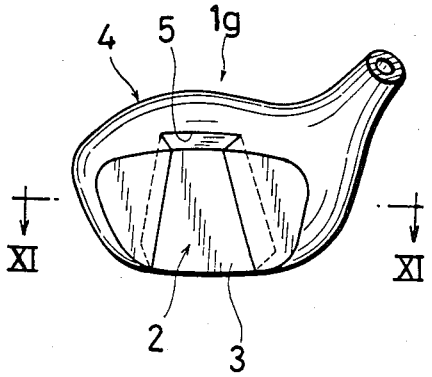
FIG. 10 is a front elevational view illustrating a further embodiment of the present invention.
Figure 11:
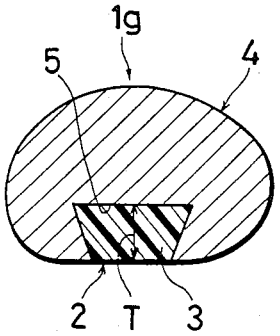
FIG. 11 is a cross section taken along lines XI—XI of FIG. 10.

FIG. 10 and 11 illustrate another embodiment of the present invention, wherein the recess has the so-called dovetail structure, and face plate 3 and the recess are substantially trapezoidal in frontal shape.

Figure 6:
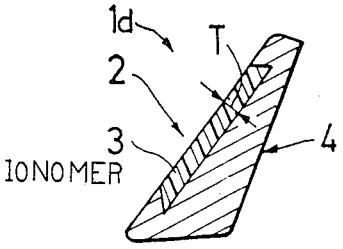
FIG. 6 is also a similar view to FIG. 2, but shows an iron-type golf club head as a further embodiment of the present invention.

FIG. 6 illustrates a further embodiment of the present invention, wherein ionomer resin face plate 3 is applied to iron-type golf club head 1*d*. More particularly, face plate 3 having the thickness T of 3 to 35 mm is embedded in metal head body 4, so that face plate 3 forms a central part of impact front face 2 of club head 1*d*. If desired, ionomer resin face plate 3 may be attached to metal club head body 4, so that the former covers the whole front face of the latter, as being apparent from the example shown in FIG. 5.

In order to illustrate the advantages of the present invention, comparison tests are conducted with respect to the following 15 club heads (hereinafter identified by reference characters C1 to C5, and A1 to A10) each having a face plate embedded in the respective wood-type club head body in the manner illustrated in FIGS. 1 to 3, wherein club heads C1 to C5 are conventional, whereas club heads A1 to A10 are those according to the present invention.

The club head bodies of club heads C1 to C5 and A1 to A10 are all made of persimmon and are subtantially the same in size and weight, while the employed face plates thereof are different in their respective properties from the other one. More particularly, the face plate of club head C1 is 3 mm in thickness T and is made of stainless steel having a compression Young's modulus E of 21,000 Kg/mm$^2$, while the face plate of club head C2 is also 3 mm in thickness T but is made of a ABS resin having a compression Young's modulus E of 280 kg/mm$^2$. Face plate of club head C3 is 8 mm in thickness T and is made of a balata resin (gutta percha) having a compression young's modulus E of 2 Kg/mm$^2$, while the face plate of club head C4 is also 8 mm in thickness T but is made of polyurethane.

On the other hand, all of the face plates of club heads A1 to A10 are made of a ionomer resin having a compression Young's modulus E of 30 kg/mm$^2$. However, the thickness T of those face plates are different from one another, that is, 3 mm club head A1; 5 mm in club head A2; 8 mm in club head A3; 10 mm in club head A4; 12 mm in club head A5; 14 mm in club head A6; 18 mmin club head A7; 20 mm in club head A8; 24 mm in club head A9; and 26 mm in club head A10.

The comparison tests are carried out by hitting a stationary golf ball with respective club heads C1 to C4 and A1 to A10 fixedly secured to a swing arm of a known swing machine in order to obtain a value of restitution coefficient defined as v/V.

Restitution coefficient =

$$\frac{v}{V} = \frac{Vb' - Vc'}{Vco - Vbo} = \frac{Vb' - Vc'}{40}$$

Vbo = Speed of ball just before the shot is made = 0 m/sec

Vco = Speed of club head just before the shot is made = 40 m/sec

Vb = Speed of ball just after the shot is made

Vc = Speed of club head after the shot is made v = Difference in speed between ball and club head just after the shot is made V = Difference in speed between head and ball just before the shot is made The employed golf balls are the so-called two-component type which is a solid core covered with an ionomer resin having a compression Young's modulus E of about 30 kg/mm$^2$.

The obtained results are shown in the following table.

TABLE

| Club Head | Material and Thickness of Face Plate | Restitution Coefficient v/V | Relative Ratio of Increase to Stainless Steel |
|---|---|---|---|
| C1 | stainless steel, 3 mm | 0.7699 | 0 |
| C2 | ABS resin 3 mm | 0.7702 | $+\frac{0.3}{1000}$ |
| C3 | ABS resin 8 mm | 0.7740 | $+\frac{4.1}{1000}$ |
| C4 | balata resin (gutta percha) 8 mm | 0.5743 | $-\frac{195.6}{1000}$ |
| C5 | polyurethane resin, 8 mm | 0.7729 | $+\frac{3.0}{1000}$ |
| A1 | ionomer resin, 3 mm | 0.7750 | $+\frac{5.1}{1000}$ |
| A2 | ionomer resin, 5 mm | 0.7803 | $+\frac{10.4}{1000}$ |
| A3 | ionomer resin, 8 mm | 0.7846 | $+\frac{14.7}{1000}$ |
| A4 | ionomer resin, 10 mm | 0.7916 | $+\frac{21.7}{1000}$ |
| A5 | ionomer resin, 12 mm | 0.7920 | $+\frac{22.1}{1000}$ |
| A6 | ionomer resin, 14 mm | 0.7969 | $+\frac{27.0}{1000}$ |
| A7 | ionomer resin, 18 mm | 0.8027 | $+\frac{32.8}{1000}$ |
| A8 | ionomer resin, 20 mm | 0.8041 | $+\frac{44.4}{1000}$ |
| A9 | ionomer resin, 24 mm | 0.8001 | $+\frac{30.2}{1000}$ |

TABLE -continued

| Club Head | Material and Thickness of Face Plate | Restitution Coefficient v/V | Relative Ratio of Increase to Stainless Steel |
|---|---|---|---|
| A10 | ionomer resin, 26 mm | 0.7973 | $+\frac{27.4}{1000}$ |

From the above results, it has been proved that the values of restitution coefficient in club heads A1 to A10 (ionomer resin face plates according to the present invention) are considerably greater than any of conventional club head C1 (stainless steel face plate), club heads C2 and C3 (ABS resin face plate), club head C4 (balata resin or gutta percha face plates) and club head C5 (polyurethane resin face plate). In particular, the values of the restitution coefficient in club heads A1 and A10 (ionomer resin) are increased by about 5/1000 to 44/1000 as compared to that in club head C1 (stainless steel). The trajectory distance of a ball will increase by 2 to 2.5 m, as the restitution coefficient gains by 1/100. The increase in the restitution of A1 to A10 (the present invention) will cause about 3 to 10 m increase in the flying distance of the golf ball when hit by a driver. The difference of 3 m in terms of the trajectory distance of a ball represents a grave meaning to golfers. The longest distance that a ball can travel, is achieved by a club head having a face plate made of ionomer and is 17 to 23 mm in thickness.

The above results are also significant in that they disprove the conventional sense and knowledge that the greater the hardness of the face plate, the greater the restitution coefficient that can be obtained.

However, the result of C4 (balata resin or gutta percha made face plate) is an exceptional case. Young's modulus of the material of C4 is too small (2.0 $Kg/mm^2$). In other words, the material of C4 is too soft for use as a face plate material.

Finally, the ionomer resin of the present invention (A1 to A10) has an optimum degree of hardness for the face plate.

The reason why the present inventors conceived the idea of utilizing an ionomer resin for the face plate of a gold club head is not because an ionomer resin had been used as a cover for a golf ball, but is based on the following:

(i) To increase the restitution coefficient between a golf ball and a golf club, the two need to be matched in frequency domain.

Assuming that,

Mb: Mass of golf ball

Mc: Mass of golf club head

Fb: Natural frequency of golf ball

Fc: Natural frequency of golf club head

Kb: Spring constant of golf ball

Kc: Spring constant of golf club head then the following relationships exist between the two:

$$Fb = \frac{1}{2\pi}\sqrt{\frac{Kb}{Mb}} \quad \text{(a)}$$

$$Fc = \frac{1}{2\pi}\sqrt{\frac{Kc}{Mc}} \quad \text{(b)}$$

Matching a golf ball and a club head in frequency domain means that the following equation exists between Fb and Fc:

$$Fb = Fc \quad \text{(c)}$$

From (a), (b) and (c), $$\frac{Kb}{Mb} = \frac{Kc}{Mc} \quad \text{(d)}$$

Generally speaking, a golf ball has a mass Mb of approx. 45 grams, while a gold club head has a mass Mc of approx. 200 grams. Thus, $$Mb \approx 45 \quad \text{(e)}$$

$$Mc \approx 200 \quad \text{(f)}$$

From (d), (e) and (f), $$Kc \approx \frac{200}{45}\, kb = 4.4Kb \quad \text{(g)}$$

This equation (g) clearly indicates that "the spring constant of the golf club head needs to be about 4 to 5 times as large as that of the golf ball."

(ii) The material of the cover of golf ball used, even when it is balata or ionomer resin, does not govern the hardness of the ball. What governs the hardness of the ball is not its cover material, but its core material.

If a golf ball is made of balata or ionomer only, an extremely hard ball would be produced, as compared with those now available on the market.

(iii) It has been proven desirable to select a material for a face plate having a modulus of elasticity of 20 to 50 $kg/mm^2$ in order to manufacture a golf club head having a spring constant which satisfies the aforementioned equation (g) in keeping with the spring constant of golf balls generally available on the market.

(iv) Such materials having moduli of elasticity of 20 to 50 $kg/mm^2$ include ionomer resin, polyurethane resin, thermoplastic polyester elastmer (example: E. I. Du Pont de Nemours Company's HYTREL), etc.

When measurements are taken regarding resiliency of these materials as club face plates, ionomer resin, among such other materials, such are found to have the largest restitution coefficient. This is due to the fact that the energy loss of the ionomer resin is smaller than the energy loss of the polyurethane resin or the thermoplastic polyester elastomer.

(v) The arguments of items (i)-(iv) clearly indicate the necessity of meeting the two requirements: first, that a golf ball and a club head must be matched in frequency domain and secondly, that a material involving small energy loss must be selected. Ionomer resin has been selected as such a material.

(vi) In summary, it is firmly believed that the performance of a golf ball is largely governed by its core material (refer to the aforementioned item (ii)) and therefore, if the only reason the material of a face plate is chosen is that it is the same material as the cover material of the golf ball, it is concluded that the restitution coefficient will not be improved.

(vii) The Felton's invention (U.S. Pat. No. 723,258) discloses that the resiliency of wooden club heads are short and could have been improved by utilizing club face plates made of gutta percha. However, the invention of Felton not provide any data concerning an improvement in resiliency.

Regardless of the golf ball, whether it is the one covered with balata or the one with covered ionomer, the golf club of the present invention markedly excels over other clubs which use balata as their face material. The reason is that the golf ball and the golf club of the present invention which uses ionomer resin as its face plate, are matched in frequency domain. Improvement in the restitution performance can not be achieved by the mere choice of using the identical material for a golf ball and a face plate.

Prior to the present invention, ionomer resin had never been used as a face plate for golf club heads, for the reasons as described hereunder:

Recently ABS resin has been playing a major role as a material for insert plates. Other materials which have been found useful include ABS resin reinforced with short glass fiber, melamine resin and epoxy resin reinforced with carbon fiber, metals such as aluminum alloys, etc., ceramic materials, etc.

All of these materials are markedly harder, than ionomer resin. The reason for such harder materials being heretofore used is that generally, hard materials are believed to involve less energy loss than softer materials. Thus the second requirement of item (v) is taken into account.

However, another requirement of item (v)—is that the first requirement—that "a golf ball and a club head must be matched in frequency domain" had never been considered before the present invention was made. Accordingly, no concept for utilizing ionomer resin with low spring constant was previously known.

Against this background, the present inventors carried out experiments and theoretical pursuits in the way of repetitive trial and error on factors which will enhance the restitution coefficient of golf ball and club and as a result, have conceived the idea that use of materials having lower spring constants—so moduli of elasticity which are smaller than those of conventional materials such as ABS resin, etc., is preferable.

The present invention being thus described, it will be obvious that same way be varied in many ways. Such variations are not to be regarded as a departure from the sprit and scope of the invention, and all such modifications as would be obvious to those skilled in the art are intended to be included within the scope of the present invention.

We claim:

1. *A golf club head of a golf club comprising* a face plate forming at least a part of the impact front face of the golf club head;

said face plate being formed of an ionomer resin having a compression Young's modulus in the range of 20 to 50 $Kg/mm^2$.

2. The golf club head as defined in claim 1, wherein the face plate is 3 to 35 mm in thickness.

3. The golf club head as defined in claim 2, wherein the face plate is 12 to 26 mm in thickness.

4. The golf club head as defined in claim 1, wherein the face plate is 8 to 30 mm in thickness.

5. The golf club head as defined in claim 4, wherein the face plate is 17 to 23 mm in thickness.

6. The golf club head as defined in claim 1, in which the golf club is an iron-type golf club, wherein the face plate forms at least a part of the impact front face of the golf club head, in which the body of the golf club head comprises metal.

7. The golf club head as defined in claim 1, in which the golf club is a wood-type golf club, wherein the face plate forms at least a part of the impact front face of the golf club head, in which the body of the golf club head comprises at least one material selected from the group consisting of wood, a synthetic resin other than an ionomer resin, carbon and a light alloy.

8. A golf club comprising the golf club head of claim 1, wherein the golf club is an iron-type golf club.

9. A golf club comprising the golf club head of claim 1, wherein the golf club is a wood-type golf club.

10. The golf club head as defined in claim 1, wherein said face plate comprises a substantially trapezoidal shape.

11. The golf club head as defined in claim 1, wherein said face plate formed covers the entire impact front face of the golf club head.

* * * * *